United States Patent [19]

Green

[11] 4,132,228

[45] Jan. 2, 1979

[54] COMFORT SUPPORT SEAT CUSHION ASSEMBLY

[75] Inventor: James A. Green, Garden Grove, Calif.

[73] Assignee: Rockwell International Corporation, El Segundo, Calif.

[21] Appl. No.: 813,918

[22] Filed: Jul. 8, 1977

[51] Int. Cl.[2] ..... A61H 1/00
[52] U.S. Cl. ..... 128/33; 128/68
[58] Field of Search ..... 128/24 R, 33, 68, 70; 297/453, 458; 5/338

[56] References Cited

U.S. PATENT DOCUMENTS

| | | | |
|---|---|---|---|
| 2,659,418 | 11/1953 | Berman | 128/68 UX |
| 2,684,672 | 7/1954 | Summerville | 128/33 |
| 3,382,511 | 5/1968 | Brooks | 128/68 UX |
| 3,611,455 | 10/1971 | Gottfried | 128/68 UX |

*Primary Examiner*—Lawrence W. Trapp
*Attorney, Agent, or Firm*—Charles T. Silberberg

[57] ABSTRACT

A comfort support seat cushion assembly to alleviate discomfort of people that are required to sit for long terms. This comfort support seat cushion provides even pressure distribution on the gluteal region with pressure relief for the ischial tuberosities, coccyx, and perineum. A pulsating means can also be provided to administer therapeutic relief to assist in alleviating discomfort for long term sedentary positions.

13 Claims, 14 Drawing Figures

FIG. 1
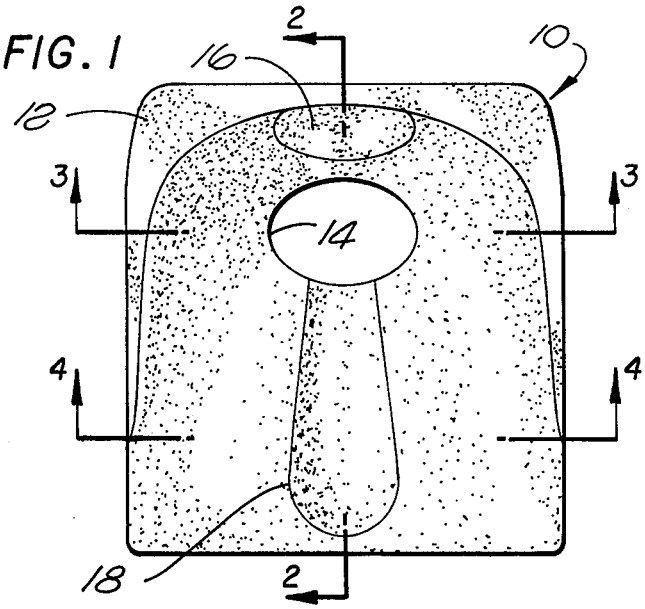
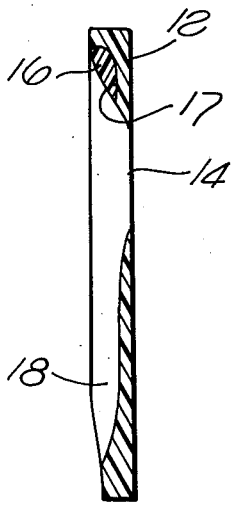
FIG. 2
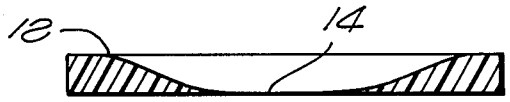
FIG. 3
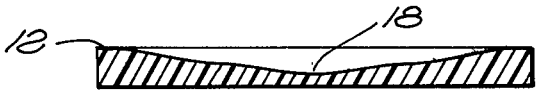
FIG. 4
FIG. 5
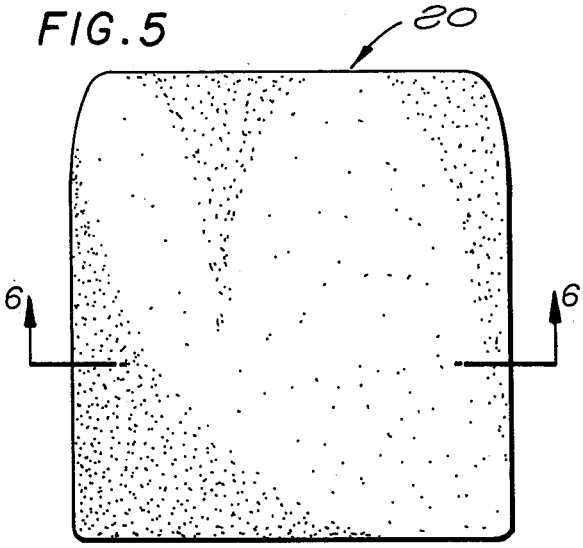
FIG. 7
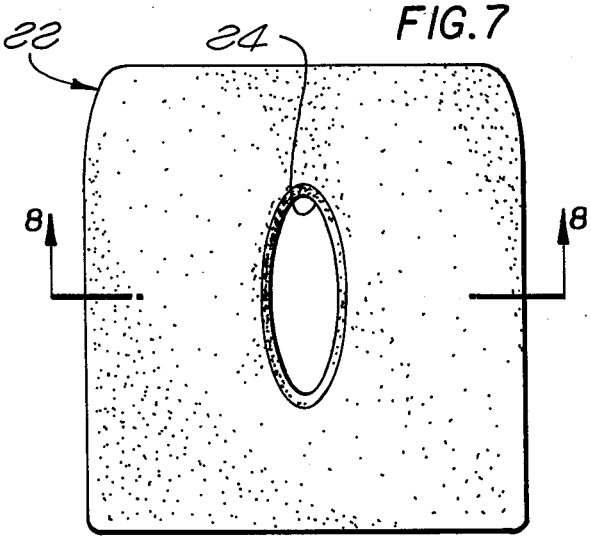
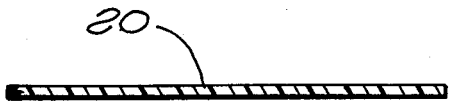
FIG. 6
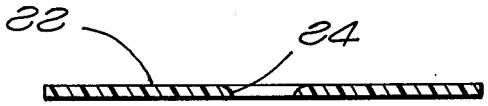
FIG. 8

FIG. 9
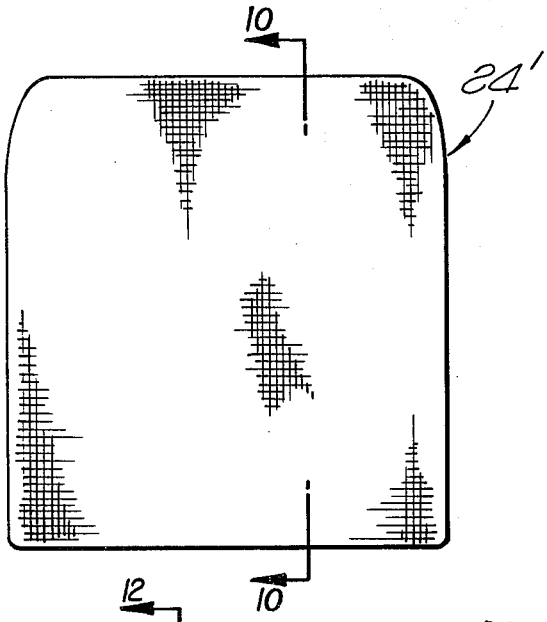
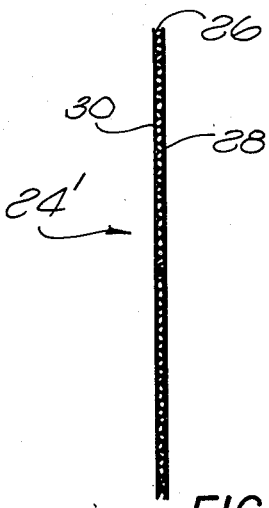
FIG. 10
FIG. 11
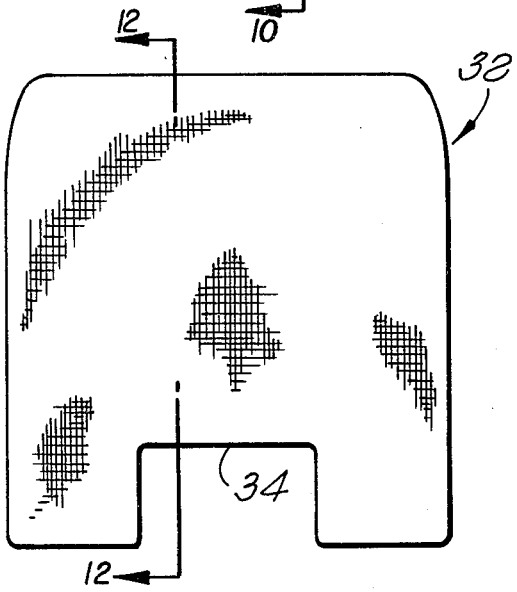
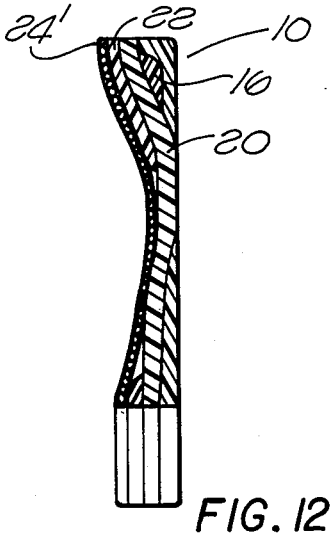
FIG. 12
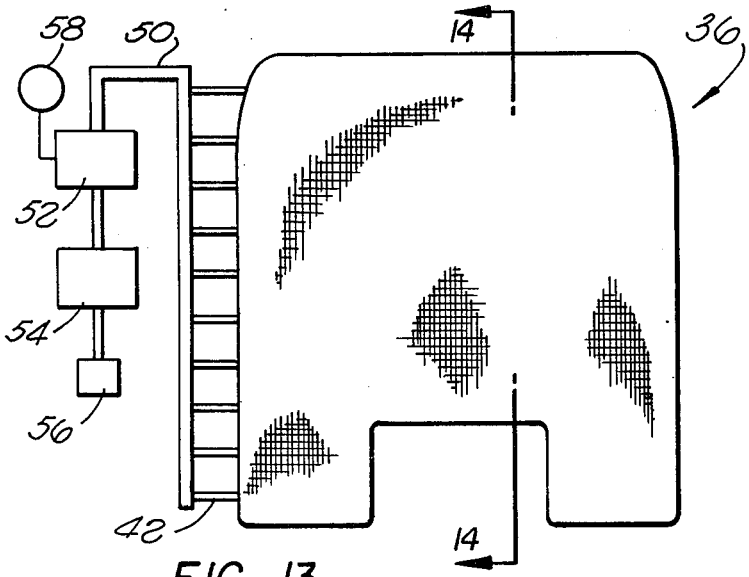
FIG. 13
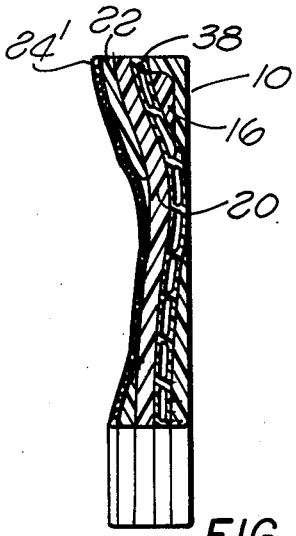
FIG. 14

COMFORT SUPPORT SEAT CUSHION ASSEMBLY

BACKGROUND OF THE INVENTION

This invention relates in general to a seat cushion assembly for supporting a human body. More particularly, this invention is directed to a comfort support seat cushion assembly that is specifically designed to alleviate discomfort, fatigue, pain, and decreased performance that accompanies long term sedentary positions. In addition, improved blood flow will result from the dynamic action that is part of this invention.

It has long been recognized that there have been a multiplicity of contoured chairs, cushions, and seats that have been designed to improve the comfort of those human beings required to sit for long terms. Doctors have always been troubled with the problems of patients that spend long times in wheel chairs. These troubles stem from phlebitis to pressure necrosis, which occurs at points on the body where the bone structure of the patient is close to the supporting surface, such as is the case of the ischial tuberosities. In addition, more recently, biomedical specialists concerned with military aircraft cockpit design have not only noticed that the crew members suffer discomfort, fatigue and pain but also decreased performance efficiency. The lack of adequate support of the back and buttocks both hastens and intensifies the occurrence of these reactions. In the specific case of military aircraft that contains an escape mechanism in the form of an ejection seat, high dynamic forces are generated by the impact of the seat cushion on the buttocks region. Therefore, to alleviate potential spinal injuries, the amount and type of material which can be used between the ischial tuberosities and the seat pan is severely limited.

Previous attempts to solve these problems have not recognized the importance of adequate weight distribution across the surfaces of the gluteal region. An inadequate weight distribution will result in excessive pressure on the ischial tuberosities. This is true for both a patient application, such as a wheel chair, and a military aircraft ejection seat application.

It has been also recognized that massage in the gluteal region will give temporary therapeutic relief along the contact surfaces to persons who have been required to sit for long terms. A number of devices have been disclosed that produce an intermittent surface pressure variation or pulsating action on the gluteal region. Other devices have been disclosed that produce translational pressure wave movement for massaging effect. One such device is exemplified in the U.S. Pat. No. 3,613,671 to Poor, et al. This patent discloses an inflatable massaging pad which includes a plurality of spaced parallel inflatable cells. An inflation means is provided along with a distributor to produce a translational pressure wave through the cells and a massaging effect.

A difficulty with this device is that the translational wave massage pumps the blood flow in both directions, away from the heart as well as toward the heart. The reverse direction, away from the heart, is potentially harmful due to the tendency to further reduce the natural blood flow and increase the potential for phlebitis. This device, therefore, would have little or no therapeutic effect but merely provide some temporary relief to the contact surface.

SUMMARY OF THE INVENTION

It is, therefore, an object of the present invention to provide a comfort support seat cushion assembly that will alleviate discomfort and help eliminate fatigue, pain, and decreased performance efficiency that accompanies long term sitting.

It is another object of the present invention to provide means of improving the blood flow in the gluteal region.

It is still another object of the present invention to provide a fire resistant comfort support seat assembly tha can also be used in an ejection seat system where high dynamic forces generated by impact during escape limits the amount and type of material that can be used.

Briefly, in accordance with the invention, there is provided a seat cushion assembly having a contoured support layer of a firm resilient foam material designed to provide an even pressure distribution over the gluteal region. Pressure relief for the ischial tuberosities is provided in the form of a hole cut in the support layer. Pressure relief for the coccyx is provided in the form of a foam material insert in the support layer. On top of the support layer, a comfort layer of medium resilient foam material is provided. Positioned on top of the comfort layer is a pressure distribution layer of soft foam material with an elongated hole in the central part to provide additional pressure relief for the perineum. A ventilation layer is also provided on top of the weight distribution layer to additionally alleviate discomfort due to increased moisture and body surface temperature. All of the layers are inserted into a porous cloth cover which has a manually operated closure.

In another form of the invention, a plurality of inflatable tubes is inserted between the support layer and the comfort layer. The inflatable tubes have an inflating means and a sequencing means which provide transitional waves only from the legs toward the heart to improve the natural blood flow.

Other objects and advantages of the invention will become apparent upon reading the following detailed description and upon reference to the drawings.

BRIEF DESCRIPTION OF THE DRAWINGS

FIG. 1 is a plan view of the support layer of the present invention showing a cutout and an insert therein;

FIG. 2 is a sectional view of the support layer taken along line 2—2 of FIG. 1;

FIG. 3 is a sectional view of the support layer taken along line 3—3 of FIG. 1;

FIG. 4 is a sectional view of the support layer taken along the line 4—4 of FIG. 1;

FIG. 5 is a plan view of the comfort layer of the present invention;

FIG. 6 is a sectional view of the comfort layer taken along line 6—6 of FIG. 5;

FIG. 7 is a plan view of the weight distribution layer of the present invention showing a cutout therein;

FIG. 8 is a sectional view of the weight distribution layer taken along line 8—8 of FIG. 7;

FIG. 9 is a plan view of the ventilation layer according to the present invention;

FIG. 10 is a sectional view of the ventilation layer taken along line 10—10 of FIG. 9;

FIG. 11 is a plan view of the present comfort support seat cushion assembly showing a forward cutout therein;

FIG. 12 is a sectional view of the assembly of FIG. 11 taken along line 12—12 of FIG. 11.

FIG. 13 is a plan view of the present comfort support seat cushion with the addition of inflatable cells and control means therefor; and FIG. 14 is a sectional view of the comfort support seat cushion of FIG. 13 taken along line 14—14 in FIG. 13.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as described by the appended claims.

DETAILED DESCRIPTION OF THE INVENTION

Referring now to FIGS. 1–4, there is shown a support layer according to the present invention generally indicated at 10. This support layer 10 is comprised of a pad 12, preferably about 1½ inches in thickness and about 18 inches square although the corners may be shaped slightly to fit in a specific seat pan (not shown). The pad 12 is made of a resilient foam material, such as Ensolite® AF having a compression resistance range from 18 to 20 lbs/in$^2$. A cutout 14, which is optimally elliptical, is provided in pad 12. The opening 14 is approximately 6 inches by 4½ inches and provides additional relief for the ischial tuberosites of the human body, in that the opening 14 accommodates the ischial tuberosities. An insert 16 is bonded in cavity 17 of the support cushion pad 12. This insert 16 is approximately 6 inches by 2½ inches and is shown in elliptical shape although other shapes may be used. Insert 16, which is approximately 1 inch deep at the rear portion as best seen in FIG. 2, is beveled such that as it slopes forward it simultaneously becomes thinner. The insert 16 is comprised of a resilient foam material, such as neoprene, with a compression resistance range from 174 to 1 lb/in$^2$ and provides additional relief for the coccyx of the human body by virtue of its soft characteristics.

With reference to FIG. 2, the cutout 14 and the gouged out nature of area 18 of the support layer 10 are clearly seen. Area 18 provides pressure relief for the perineum. FIG. 3 shows contouring 15 of the support layer 10 and the cutout 14. FIG. 4 shows contouring 15 at a forward position of layer 10 and also shows the gouged out area 18. The contouring 15 of the support layer 10 provides an even pressure distribution in the gluteal region and will accommodate the majority of male gluteal regions, i.e. from the 5th to the 95th percentile.

Referring to FIG. 5, there is seen the comfort layer generally indicated at 20. This layer is the same shape generally as the support layer 10 and in the preferred embodiment fits directly and evenly on top of the support layer 10. The comfort layer 20 is composed of a resilient foam material, such as Ensolite ®M, with a compression resistance range of 1 to 3 lbs/in$^2$ and is approximately ⅝" to 1" in thickness for a wheel chair type application and normally a maximum of ½ inch for military seat applications. As shown in FIG. 6, the thickness is optimally uniform.

FIG. 7 is a plan view of the weight distribution layer generally indicated at 22. This layer which is about ½" in thickness is also preferably the same shape generally as support layer 10 and fits directly and evenly on top of comfort layer 20. An elliptical cutout 24 is made in the center portion of the weight distribution layer 22 and in the preferred embodiment is approximately 9 inches by 3½ inches. This cutout 24 prevents bunching of material in the center of the weight distribution layer 22 which would create pressure on the perineum. The weight distribution layer 22 is composed of a resilient foam material, such as neoprene, with a compression resistance range from ¼ to 1 lb/in$^2$. By virtue of this low compression resistance, layer 22 smooths out imperfections in contouring of the other layers.

FIG. 8 which is a cross-section view of the weight distribution layer 22 shown the uniform thickness of layer 22 and the chamfered edge of the ridge of the cutout 24.

FIG. 9 illustrates the ventilation layer generally indicated at 24'. Preferably, this layer is approximately ¼ inch in thickness and is made up of a porous, fibrous, woven material, such as space fabric, consisting of semi-rigid, porous tubes 26 (FIG. 10) sandwiched transversely between two layers of porous cloth 28 and 30. The cloth layers 28 and 30 are joined to the tubes 26 either by weaving or bonding. Ventilation layer 24' is optimally the same general shape as the support layer 10 and fits directly on top of the weight distribution layer 22.

FIG. 11 illustrates the comfort support seat cushion assembly generally indicated at 32. A cutout 34 approximately 7 inches by 4 inches, can be made in the assembly 32, if desired, to accommodate a seat harness, such as would be the case if the assembly 32 were to be used as an aircraft crew seat.

FIG. 12 is a cross section of the comfort support seat cushion assemby 32 and illustrates the integration of the support layer 10, the comfort layer 20, the weight distribution layer 22, and the ventilation layer 24'. In order to provide ease of handling and prevent dislocation of layers, the comfort layer 20, the weight distribution layer 22, and the ventilation layer 24' are preferably bonded together with a suitable bonding material. Also shown in FIG. 12 is the soft insert 16 that provides pressure relief of the coccyx. The entire assembly 32 is encased in a cover (not shown) composed of a porous, washable material with a fastening means, such as Velcro, preferably on the rear portion of the cover, that allows closing of the opening in the cover after the assembly is inserted.

FIGS. 13 and 14 illustrate another embodiment of the comfort support seat cushion which is generally indicated at 36. Assembly 36 has a series of flexible air cells 38 spaced parallel and sandwiched between the support layer 10 and the comfort layer 20. Each of the flexible cells may be made of rubber, plastic, or an anagolous flexible material. It is found however that silicone rubber is an excellent material for those cells as it is both wear resistant (which produces a long life) and fireproof. FIG. 14 shows the positioning of these cells 38 to the layers 10, 20, 22, and 24' of assembly 36. Layers 10, 20, 22, and 24' are the same as previously described. Each cell 38 is closed on one end and connected at the other end to a flexible tube 42 as indicated in FIG. 13. Connected to these tubes 42 is a manifold 50. A distribution means 52 which is like that described in U.S. Pat. No. 3,613,671, to Poor, et al sequentially distributes compressed air from inflatable means 54 (a source of compressed air). The distribution means 52 can be regulated to provide a sequencing of the pressure in the cells 38 to produce a transverse wave from the front of the seat to the rear only. This transverse wave improves the blood flow in the human body by forcing the blood from the legs toward the heart.

Also preferably included in this embodiment are a pressure regulator 56 and rate sequencing means 58.

Rate sequencing means 58 is preferably a rheostat which varies the imput power to the motor (not shown) driving the distribution means 52. This allows the user to vary both the intensity and rate of transverse wave travel to further alleviate discomfort from long sedentary positions.

Thus, it is apparent that there has been provided, in accordance with the invention, a comfort support seat cushion that fully satisfies the objectives, aims, and advantages set forth above. While the invention has been described in conjunction with specific embodiments thereof, it is evident that many alternatives, modifications, and variations will be apparenrt to those skilled in the art in light of the foregoing description. Accordingly, it is intended to embrace all such alternatives, modifications, and variations which fall within the spirit and scope of the appended claims.

What is claimed is:

1. A comfort support seat cushion assembly for a human body comprising:

(a) a support layer of resilient material of a given compression resistance having a top surface and a bottom surface, said bottom surface being flat, said top surface being contoured to slope inwardly and downwardly to form a forward-facing depression, said contouring providing an even pressure distribution on the gluteal region of a person seated on the assembly, said support layer having a hole therethrough, said hole providing pressure relief for the ischial tuberosities of a person seated on the assembly, said upper surface having a contoured groove extending from said hole toward the foward edge of said support layer, said groove providing pressure relief for the perineum of a person seated on the assembly, a recess positioned in said top surface rearwardly of said hole, a resilient insert having a compression resistance less than said given compression resistance being provided in said recess, said insert being contoured to match said upper surface contouring, said insert providing pressure relief to the coccyx of a person seated on the assembly;

(b) a comfort layer of resilient foam material of a compression resistance less than said given compression resistance, said comfort layer being the same general size and shape as said support layer and being evenly positioned on top of said support layer, said comfort layer having a substantially uniform thickness;

(c) a weight distribution layer of resilient foam material of a compression resistance less than said compression resistance of said comfort layer, said weight distribution layer being of the same general size and shape of said support layer and being evenly positioned on top of said comfort layer, said weight distribution layer having a hole therethrough providing a pressure relieving recess for the perineum of a person seated on the assembly, said weight distribution layer having a substantially uniform thickness; and (d) a ventilation layer having two layers of woven, porous cloth and a plurality of woven, porous, semi-rigid tubes sandwiched between said layers of woven porous cloth and spaced parallel in a transverse direction along the assembly, said ventilation layer being of the same general size and shape as said support layer and positioned evenly on top of said weight distribution layer, said ventilation layer providing relief to temperature increase and water vapor build-up in the assembly.

2. The comfort support seat cushion assembly of claim 1 wherein the assembly has a longitudinal center line; and said groove, said recess, said hole in said support layer, and said hole in said weight distribution layer are symmetrically divided by said center line.

3. The comfort support seat cushion assembly of claim 2 wherein the front end of the assembly has a portion symmetrically divided by said center line cut out therefrom.

4. The comfort support seat cushion assembly of claim 2 wherein said hole in said weight distribution layer has a beveled edge.

5. The comfort support seat cushion assembly of claim 1 wherein said support layer has a compression resistance range from about 18 to 20 lbs/in$^2$, said insert has a compression resistance range from about $\frac{1}{4}$ to 1 lb/in$^2$, said comfort layer has a compression resistance range from about 1 to 3 lbs/in$^2$, and said weight distribution layer has a compression resistance range from about $\frac{1}{4}$ to 1 lb/in$^2$.

6. The comfort support seat cushion assembly of claim 2 wherein said support layer has a compression resistance range from about 18 to 20 lbs/in$^2$, said insert has a compression resistance range from about $\frac{1}{4}$ to 1 lb/in$^2$, said comfort layer has a compression resistance range from about 1 to 3 lbs/in$^2$, and said weight distribution layer has a compression resistance range from about $\frac{1}{4}$ to 1 lb/in$^2$.

7. The comfort support seat cushion assembly of claim 6 wherein the front end of the assembly has a portion symmetrically divided by said center line cut out therefrom, said hole in said weight distribution layer has a beveled edge, and said comfort layer, said weight distribution layer, and said ventilation layer are bonded together.

8. The comfort support seat cushion assembly of claim 7 also including inflatable massaging means for improving the blood flow from the legs toward the heart of a person seated on the assembly, said inflatable massaging means including a plurality of elongated inflatable cells placed parallel in a transverse direction to said center line between said support layer and said comfort layer, a distribution means for sequentially inflating and deflating said inflatable cells to produce translational pressure waves from the front portion to the rear portion of the assembly, a pressure regulator for varying the intensity of the pressure waves, and a rate sequencing means for varying the rate of translation of the pressure waves.

9. The comfort support seat cushion assembly of claim 2 wherein said comfort layer, said weight distribution layer, and said ventilation layer are bonded together.

10. The comfort support seat cushion assembly of claim 1 also including inflatable massaging means for improving the blood flow from the legs toward the heart of a person seated on the assembly.

11. The comfort support seat cushion of claim 10 wherein said inflatable massaging means includes a plurality of elongated inflatable cells spaced parallel in a transverse direction to said center line between said support layer and said comfort layer.

12. The comfort support seat cushion assembly of claim 11 wherein said inflatable massaging means also includes a distribution means for sequentially inflating and deflating said inflatable cells to produce translational pressure waves from the front portion to the rear portion of the assembly.

13. The comfort support seat cushion assembly of claim 12 wherein said inflatable massaging means also includes a pressure regulator for varying the intensity of the pressure waves and rate sequencing means for varying the rate of translation of the pressure waves.

* * * * *